United States Patent [19]

Tatro

[11] Patent Number: 4,602,456

[45] Date of Patent: Jul. 29, 1986

[54] SHUTTER WITH MOVABLE SLATS

[75] Inventor: Michael J. Tatro, Wausau, Wis.

[73] Assignee: Wausau Metals Corporation, Wausau, Wis.

[21] Appl. No.: 607,195

[22] Filed: May 4, 1984

[51] Int. Cl.[4] ..... E06B 11/00; A47H 1/00

[52] U.S. Cl. ..... 49/75; 160/107; 160/193; 49/86

[58] Field of Search ..... 49/75, 76, 86, 91; 160/170, 107, 193, 187, 182, 174; 403/402, 403, 295, 231

[56] References Cited

U.S. PATENT DOCUMENTS

| | | | |
|---|---|---|---|
| 73,213 | 1/1868 | Wharry . | |
| 176,789 | 5/1876 | Ingram . | |
| 1,238,703 | 4/1917 | Wendelken . | |
| 2,170,877 | 8/1939 | Simon | 160/107 |
| 2,249,641 | 7/1941 | Stucki | 160/107 |
| 2,311,300 | 2/1943 | Dubour . | |
| 2,317,994 | 5/1943 | Huff . | |
| 2,324,536 | 7/1943 | Pratt | 160/170 |
| 2,359,289 | 10/1944 | Brown . | |
| 2,499,692 | 3/1950 | Spratt | 49/86 |
| 2,631,339 | 3/1953 | Pratt . | |
| 2,679,666 | 6/1954 | Burchill | 49/75 |
| 2,877,841 | 3/1959 | Grabove | 160/91 |
| 3,008,196 | 11/1961 | Springer et al. . | |
| 3,022,549 | 2/1962 | Cummings . | |
| 3,128,823 | 4/1964 | Klopstad . | |
| 3,291,193 | 12/1966 | Hagerty et al. . | |
| 3,324,620 | 6/1967 | Requena . | |
| 3,326,267 | 6/1967 | Hauck . | |
| 3,366,159 | 1/1968 | Arnold et al. . | |
| 3,443,624 | 5/1969 | Toth . | |
| 3,703,920 | 11/1972 | Debs . | |
| 3,719,221 | 3/1973 | Hanson | 160/107 |
| 3,849,762 | 9/1958 | McCarthy . | |
| 4,369,828 | 1/1983 | Tatro . | |

FOREIGN PATENT DOCUMENTS

| | | | |
|---|---|---|---|
| 1145103 | 3/1968 | United Kingdom | 160/107 |

*Primary Examiner*—William E. Lyddane
*Assistant Examiner*—Gerald A. Anderson
*Attorney, Agent, or Firm*—Isaksen, Lathrop, Esch, Hart & Clark

[57] ABSTRACT

A shutter adapted to be attached in hinged relation to a frame defining an opening, whereby at least part of the opening may be covered by the shutter, includes a shutter body. The shutter body has opposed top and bottom and opposed side body members, the body members defining a shutter opening. A plurality of movable slats extend horizontally across the shutter opening. The slats are individually suspended and vertically spaced from each other by at least two flexible ladder suspension harnesses. Each harness has two parallel vertical strands with each slat held in fixed relation to a selected location on each of the vertical strands. Lateral movement of the slats is limited by the vertical strands and longitudinal movement of the slats is limited by the side body members. Means are provided to selectively lower and raise at least one of the vertical strands of each harness to rotate the slats about their longitudinal axes.

9 Claims, 6 Drawing Figures

SHUTTER WITH MOVABLE SLATS

TECHNICAL FIELD

The present invention relates to shutters in general and, in particular, to shutters in which the slats may be moved.

BACKGROUND OF ART

Those skilled in the art are cognizant of a variety of shutter designs, including shutters having a central opening closed by movable slats. Examples include Wharry, U.S. Pat. No. 73,213; Ingram, U.S. Pat. No. 176,789; Wendelken, U.S. Pat. No. 1,238,703; Dubour, et al., U.S. Pat. No. 2,311,300; Huff, U.S. Pat. No. 2,317,994; Brown, U.S. Pat. No. 2,359,289; and Grabove, U.S. Pat. No. 2,877,841.

Commonly, such shutters employ one of two basic types of mechanisms to coordinate the movement of the slats. In the first, a vertical bar is attached in common to all of the slats. The slats then rotate in a coordinated manner about their longitudinal axes on pins that are driven into the surrounding body of the shutter. Ingram illustrates an early example of such a structure. Other shutters include slats the ends of which are mounted in mechanisms that are moved simultaneously by means of a mechanical linkage operating at the sides of the shutter. Wharry, Wendelken, Dubour, et al., Huff, and Grabove, all present examples of such structures.

In all of the examples referred to above, the slats are attached to the surrounding body of the shutter at the ends of the slats by means of a mechanism that is subject to being broken or bent if the slats sustain a blow or are otherwise stressed. Likewise, moving parts located at the ends of the slats are exposed to dust and grime introduced with the air passing through the shutter. Consequently, the shutter's working parts are especially subject to being jammed, stuck, or simply impeded by distortion or buildup of foreign matter.

BRIEF SUMMARY OF THE INVENTION

The present invention is summarized in that a shutter adapted to be attached in hinged relation to a frame defining an opening, whereby at least part of the opening may be covered by the shutter, includes a shutter body. The shutter body has opposed top and bottom and opposed side body members, the body members defining a shutter opening. A multiplicity of movable slats extend horizontally across the shutter opening. The slats are individually suspended and vertically spaced from each other by at least two flexible ladder suspension harnesses. Each harness has two parallel vertical strands, with each slat held in fixed relation to a selected location on each of the vertical strands. Lateral movement of the slats is limited by the vertical strands and longitudinal movement of the slats is limited by the side body members. Means are provided to selectively lower and raise at least one of the vertical strands of each harness to rotate the slats about their longitudinal axes.

A primary object of the invention is to provide a shutter the slats of which are adjustable to allow a user to control the flow of air or passage of light through the shutter.

A second object of the invention is to provide for such a shutter in which the slats may be rotated about their longitudinal axes and be maintained in a stable manner in the position to which they have been turned.

Another object of the invention is to provide for adjustable slats in a shutter in which the ends of the slats are not attached directly to the enclosing body of the shutter.

A further object of the invention is to provide for adjustable slats in a shutter in which substantially all moving mechanical linkages and the like are covered and thereby protected from the accumulation of dust, grime, grease, and the like.

Yet another object of the invention is to provide a shutter with adjustable slats in which a single knob may be utilized both to adjust the slats and to conveniently open and shut the shutter as it is hinged within the frame of the opening it closes.

A further object of the invention is to provide a shutter in which movable slats are suspended by flexible ladder suspension harnesses, and in which means are provided to keep the suspension harnesses tautly stretched in spite of changes in humidity, temperature, or other conditions that might affect the dimensions of the frame of the shutter or the length of the harnesses.

A further object of the invention is to provide means for accurately aligning and strongly fastening the corners of the shutter in combination with means for locating and supporting the moving parts of the mechanism of the shutter.

Other objects, features, and advantages of the invention will be apparent from the following detailed description taken in conjunction with the accompanying drawings showing a preferred embodiment of a shutter exemplifying the principles of the invention.

DETAILED DESCRIPTION OF THE PREFERRED EMBODIMENT

Figure 1:
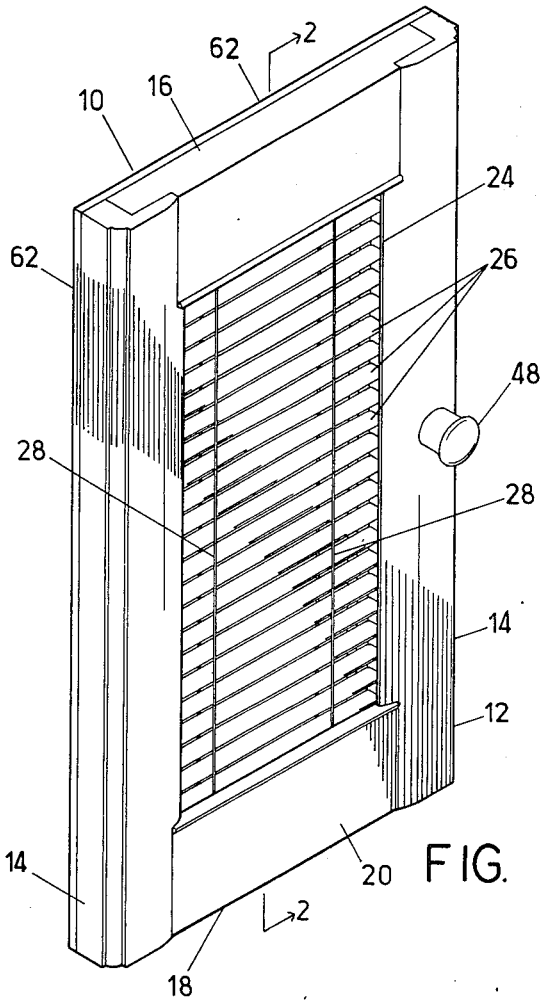
FIG. 1 is a perspective view of a shutter constructed in accord with the present invention.
Figure 2:
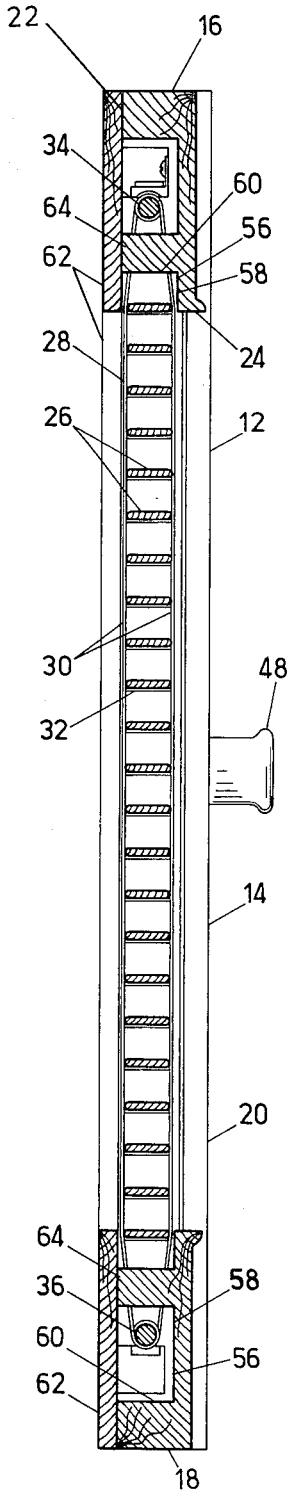
FIG. 2 is a cross sectional view of the shutter of FIG. 1 taken along section line 2—2.
Figure 4:
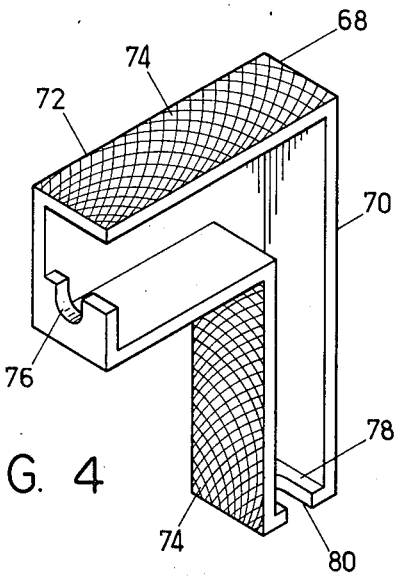
FIG. 4 is a perspective view of a corner brace.

Referring more particularly to the drawings, wherein like numbers refer to like parts, FIG. 1 shows a shutter, generally indicated at 10, constructed in accord with the present invention. The shutter has a generally rectangular shutter body 12 having opposed side body members 14 that extend for the vertical length of the shutter. Opposed top and bottom body members 16, 18 extend between the side body members 14 to define the generally rectangular shape of the shutter body 12. The shutter body 12 has front and rear sides 20, 22. The top, bottom, and side body members 16, 18, 14 define and enclose a generally centered shutter opening 24 extending through the shutter body from the front to the rear side.

A plurality of movable slats 26 extend horizontally across the shutter opening 24 substantially from one side body member 14 to the other. Preferably, the movable slats 26 are generally flat, with the planes defined by each of the flat slats being parallel. The movable slats 26 are adapted to rotate about their longitudinal axes to move from an open position, wherein the planes of the movable slats are oriented generally at right angles to the front and rear sides 20, 22, to a closed position, in which the slats are rotated approximately 90 degrees from the open position. In the closed position, the movable slats 26 overlap each other, effectively closing the shutter opening 24 and controlling the passage of light and air therethrough.

The movable slats 26 are individually suspended and vertically spaced from each other by at least two flexible ladder suspension harnesses 28. Each harness 28 has two, parallel vertical strands 30 that extend generally parallel to the side members 14 for the vertical length of the shutter opening 24. The parallel vertical strands 30 of each harness 28 are adapted to move vertically relative to each other, preferably by the mechanism disclosed below. A plurality of lateral support strands 32 extend between the vertical strands 30, one at each desired location of a slat 26. Each slat 26 rests on one lateral support strand 32 of each harness 28. The harnesses 28 are spaced from each other at a selected distance to provide two points of support for each slat 26, so that the slats may be held in a stable fashion without an inclination to tip from end to end. Lateral movement of the slats 26 is limited by the vertical strands 30 of the harnesss 28, and longitudinal movement of the slats is limited by the side body members 14. Rotational movement of the slats 26 about their longitudinal axes is controlled by the orientation of the lateral support strands 32, which is controlled, in turn, by the relative position of the vertical strands 30.

Figure 3:
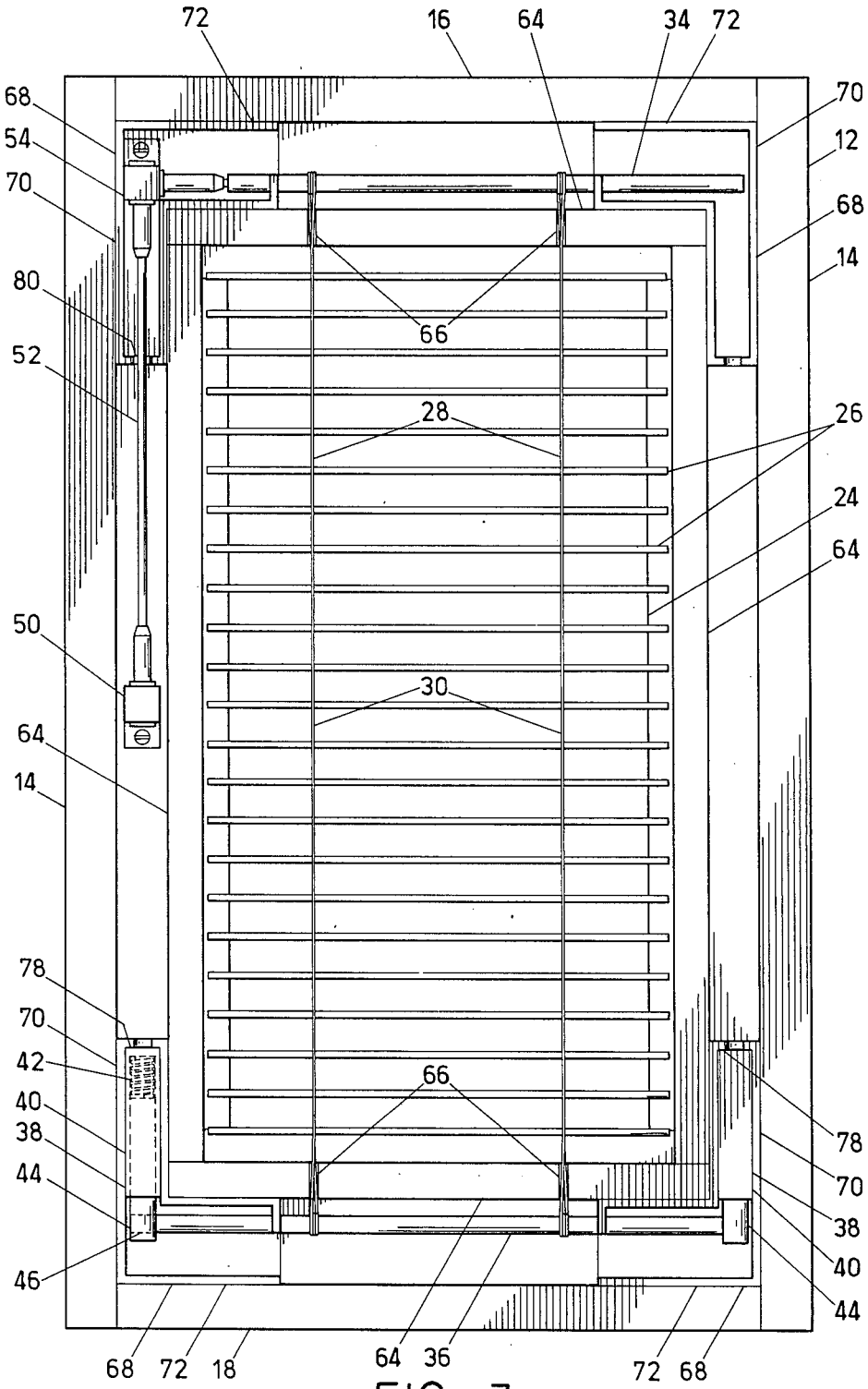
FIG. 3 is a rear elevation view of the shutter of FIG. 1 with the cover plates removed.

The shutter 10 of the invention includes a control mechanism adapted to selectively lower and raise at least one of the vertical strands 30 of each harness 28. By this means, the orientation of all of the lateral support strands 32 may be simultaneously changed, together with that of the slats 26 supported thereby, allowing the slats to be moved as a group between their open and closed positions. The control mechanism has a tilt bar 34 rotatably mounted on the body 12. The tilt bar 34 is located above or below the slats 26, but preferably is above the uppermost slat, as is best shown in FIG. 3. At least one of the vertical strands 30 of each harness 28 is wound onto the tilt bar 34. As the tilt bar 34 is turned about its longitudinal axis, the vertical strand 30 wound thereon is either wound up or unwound, effectively lowering or raising the strand. Preferably, both parallel vertical strands 30 of a given harness 28 are wound on the tilt bar 34 in opposite directions, so that as one strand is lowered, the other is raised. Thus, the lateral support strands 32 and the slats 26 resting thereon may be rotated about the longitudinal axes of the slats.

Preferably an anchor bar 36 is rotatably mounted on the body 12 parallel to the slats 26 and beyond the slat most remote from the tilt bar 34. Preferably the anchor bar 36 is located beneath the lowermost slat 26. The lowermost ends of the vertical strands 30 of the harnesses 28 are attached to the anchor bar 36, which then rotates with the slats 26. Alternatively, the anchor bar 36 may be non-rotatably mounted with the lowermost ends of the vertical strands 30 of each harness 28 being joined, passing beyond and over the anchor bar and slipping freely over it as the tilt bar 34 is turned. By these or equivalent means, the moving harnesses 28 may be kept taut and stretched over the vertical length of the shutter 10.

Preferably the anchor bar 36 is biased away from the tilt bar 34. In the preferred embodiment, the ends of the anchor bar 36 are attached to a tension device 38 that in turn is attached to the side body members 14. For purposes of description only, it will be assumed that the anchor bar 36 is at the bottom of the shutter 10. The tension device 38 has a downwardly opening cylinder 40 extending substantially parallel to the vertical strands 30 and rigidly attached to the adjacent side body member 14. A compression spring 42 is received in the cylinder 40, and a piston 44 is received in the cylinder after the insertion of the compression spring. The cylinder 40, spring 42, and piston 44 are shown in phantom in FIG. 3. By means of the compression spring 42, the piston is biased in a downwardly direction. The piston 44 has a hole 46, also shown in phantom in FIG. 3, adapted to receive an end of the anchor bar 36 in freely turning relation. Preferably each end of the anchor bar 36 is so mounted in a tension device 38, alternative forms of which will be apparent to one skilled in the art. By this means, the vertical strands 30 may be kept taut in spite of stretching or shrinkage of the strands or slight alterations in the length of the body members 14 or other parts of the shutter 10 in response to changes in temperature, humidity, age, or the like.

A manually actuatable control knob 48 is attached to the shutter body 12 and is adapted to be moved by a user of the shutter 10. A mechanical linkage converts the motion of the control knob 48 into rotational motion of the tilt bar 34. Preferably, the control knob 48 is adapted to be turned about an axis extending generally at right angles to the front side 20, as is illustrated by the control knob shown in FIG. 3. Preferably the control knob is located in one of the side body members 14 and, when turned, actuates a first beveled gear system 50, shown in FIG. 3. A control rod 52 extends from the first beveled gear system 50 upwardly toward the top body member 16, where it is attached to a second beveled gear system 54. The second beveled gear system 54 is attached to the tilt bar 34. The first and second beveled gear systems 50, 54 are rigidly attached to the shutter body 12 by, glue, screws or equivalent means for fastening. The tilt bar 34, is held in place by any convenient means, a preferred means for holding the tilt bar being disclosed below.

When the control knob 48 is turned, the first beveled gear system 50 transmits that motion to the control rod 52, causing it to rotate. In turn, the second beveled gear system 54 transmits the rotational motion of the control rod 52 to the tilt bar 34. Thus, when the control knob 48 is turned, the vertical strands 30 wound on the tilt bar are lowered and raised. By the mechanism disclosed above, the slats 26 may thus be moved between their open and closed positions. Taken together, the control knob 48, first beveled gear system 50, control rod 48, second beveled gear system 54, and tilt bar 34 constitute means to selectively lower and raise at least one of the vertical strands 30 of each harness 28. However, other mechanical linkages of conventional sorts could be substituted for that disclosed to provide equivalent means to selectively lower and raise the vertical strands 30, all within the scope and spirit of the invention.

The location of the control knob 48 disclosed is preferred in that it may provide a centrally located, easily accessible knob that may be grasped by the user and used as a convenient knob for moving the shutter 10 relative to the frame to which it is hinged. However, other locations of the control knob 48 may be used and are all within the scope and spirit of the invention.

Preferably each of the side, top, and bottom body members 14, 16, 18 has a recess 56 that extends the length of the body member. The recess 56 in each body member 14, 16, 18 is defined by a recess side 58 and a recess back 60. The recess side 58 is generally parallel to the front and rear sides 20, 22 and extends from the shutter opening 24 outwardly. The recess back 60 extends between the recess side 58 and the rear side 22. Each body member 14, 16, 18 has a cover plate 62 fastened to the rear side 22 of the body member and extending generally parallel to the recess side 58 to the shutter opening 24. A cover member 64 extends between the recess side 58 and cover plate 62 of each body member 14, 16, 18 at a point intermediate the recess back 60 and the shutter opening 24.

The first and second beveled gear systems 50, 54, control rod 52, and tilt and anchor bars 34, 36 are all located within the recesses 56 of the body members 14, 16, 18, and in each case behind the cover member 64 associated with the recess 56 involved. The cover members 64 associated with the top and bottom body members 16, 18 have access slots 66 through which the vertical strands 30 of the ladder suspension harnesses 28 extend to be wound on the tilt and anchor bars 34, 36. By this arrangement, almost all of the movable parts of the means to selectively lower and raise the vertical strands 30 are enclosed and thus protected from any buildup of grime, dust, or debris carried by the air passing through the shutter that might otherwise interfere with the operation of the shutter. Furthermore, the gear system-control rod-tilt and anchor bar system described above, or its equivalent, may be conveniently hidden from view, allowing the shutter 10 to closely resemble a shutter with fixed slats. Thus, a durable shutter 10 with movable slats 26 that automatically move simultaneously so as to maintain their relative orientation may be made to have substantially the appearance of a fixed slat shutter, with no vertical rod linking the slats and without any exposed levers, slides, or the like located at the ends of the slats. The ends of the slats 26 extend into the recess 56 of the adjacent side body member 14, so that parts of the side body members 14 and associated cover plates 62 overlap the ends of the slats 26. Consequently, the slats are prevented from moving forwardly or rearwardly out of the shutter opening 24 in the event wind, the swinging of a shutter, or the like exceeds the ability of the vertical strands 30 to confine the slats. Furthermore, by this arrangement the shutter 10 provides a complete visual screen when the slats 26 are in their closed position, blocking both sight and the passage of light that would occur if there were an unscreened gap between the side body members 14 and the ends of the slats 26.

Preferably the shutter 10 incorporates corner braces 68. Each corner brace 68 includes a vertical member 70 and horizontal member 72 joined at a substantially right angle. The vertical and horizontal members 70, 72 are made of a channel material having a cross sectional shape resembling a flat-bottomed U. Outwardly facing surfaces 74 of the vertical and horizontal members 70, 72 are adapted to bind securely with glue. Preferably the outwardly facing surfaces 74 are roughened to achieve that effect. The end of the horizontal member 72 remote from the vertical member 70 is partially closed and includes a simple bearing 76 adapted to receive and hold in turning relation the tilt bar 34 or anchor bar 36 with the longitudinal axis of the bar being held substantially parallel to that of the horizontal member 72. Preferably the bearing 76 is substantially U-shaped with the U opening away from the direction in which the vertical member 70 extends from its point of connection with the horizontal member 72. The corner braces 68 may be made of any suitably rigid and strong material, but preferably they are made unitarily of a moldable plastic material of selected elastic flexibility. When made of such a material, the part of the bearing 76 that is open, as described above, may have a diameter slightly less than that of the tilt bar 34. The tilt bar 34 may then be forced through the opening into the bearing 76, the corner brace 68 flexing slightly to admit the tilt bar and then elastically snapping back to retain it within the bearing.

The corner braces 68 are adapted to be received within the recesses 56 of adjoining members of the shutter body 12 with the vertical member 70 of each corner brace lying adjacent to the recess back 58 of a side body member 14 and the horizontal member 72 lying adjacent to the recess back of the top or bottom body member 16, 18 joined to the side body member. By this means, the joint between the body members is strengthened and maintained at a right angle. The width of the vertical and horizontal members 70, 72 of the corner braces 68 is selected to be the same as the desired separation between the recess back 58 and the cover member 64, so that the cover members associated with joined shutter body members may likewise be adhered to the corner braces and thus be regularly spaced, reinforced, and maintained at right angles to each other. It will be appreciated from the disclosure above that a single configuration of corner brace 68 may be used in any of the four corners of the shutter body 12. However, it is desirable that all of the corner braces 68 open rearwardly, so that the side, top, and bottom body members 14, 16, 18 may first be assembled, with the tilt and anchor bars 34, 36 and their associated mechanisms then being put in place from the rearward side of the shutter body 12 with maximum convenience. Consequently, left- and right-hand configurations of the corner brace 68 are desirable, as may be appreciated from an inspection of FIG. 3.

Preferably the vertical member 70 of the corner brace 68 has a floor 78 partially closing the end of the vertical member. The floor 78 is provided with a control rod access hole 80 to provide an unobstructed route for the control rod 52 to extend between the first and second beveled gear systems 50, 54. The cylinder 40 preferably fits snuggly within the vertical member 70 of the corner brace 68 and may be retained therein by the floor 78. Thus, when the side and bottom body members 14, 18 have been assembled with the use of corner braces 68 in the manner disclosed above, the tension device 38 may be placed within the vertical member 70, with the piston 44 extending toward the bottom body member 18, the floor 78 serving to prevent movement of the tension device 38 when the piston 44 is depressed. In practice, it is most convenient to assemble two tension devices 38, slipping one on each end of an anchor bar 36 in the manner disclosed above. The tension devices 38 may then be placed within the vertical members 70 of the corner braces 68. When the cover plates 62 associated with the side and bottom body members 14, 18 have been fastened in place, the tension devices 38 and anchor bar 36 are secured and prevented from moving out of place.

All rigid parts of the shutter 10 may be made of wood, plastic, metal, or any convenient, rigid material. Joined parts may be fastened together with glue, screws, nails, rivets, or other conventional means for fastening. The flexible ladder suspension harnesses 28 may be made of plaited strands of fibers, such as cotton, nylon, or the like, or from any suitably flexible material.

Figure 5:
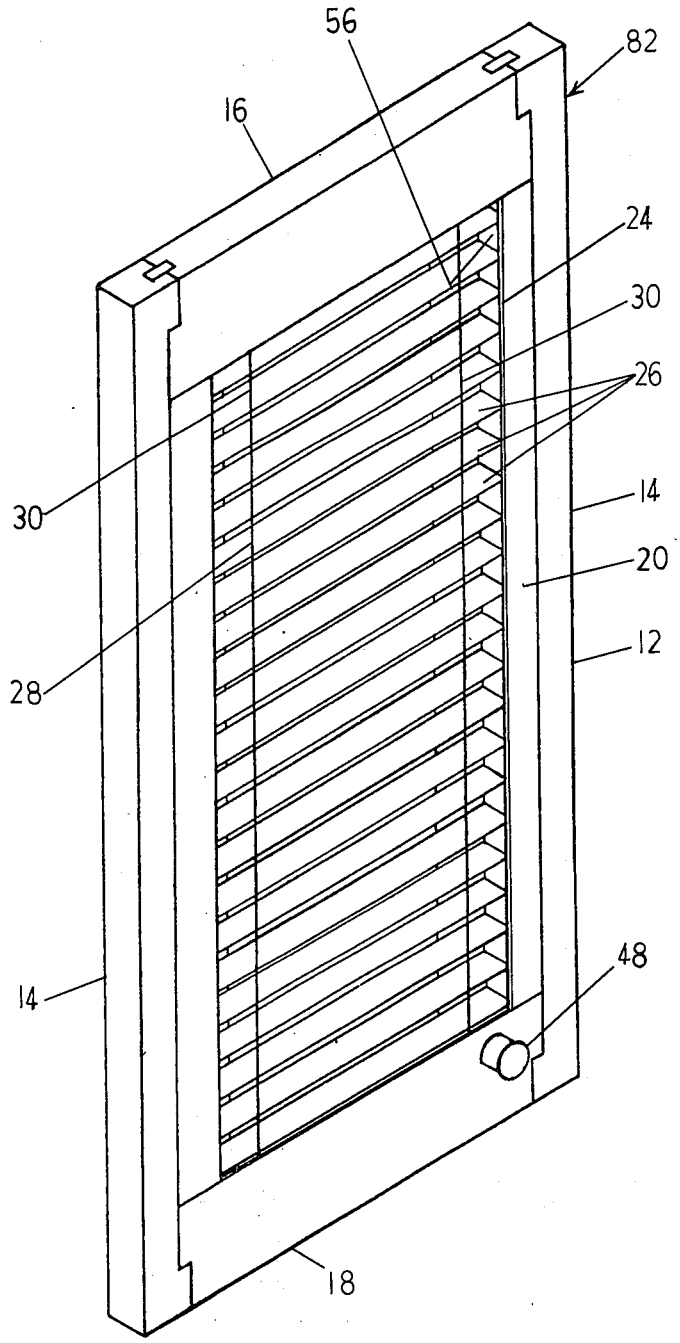
FIG. 5 is a first alternative embodiment of the shutter of the invention.
Figure 6:
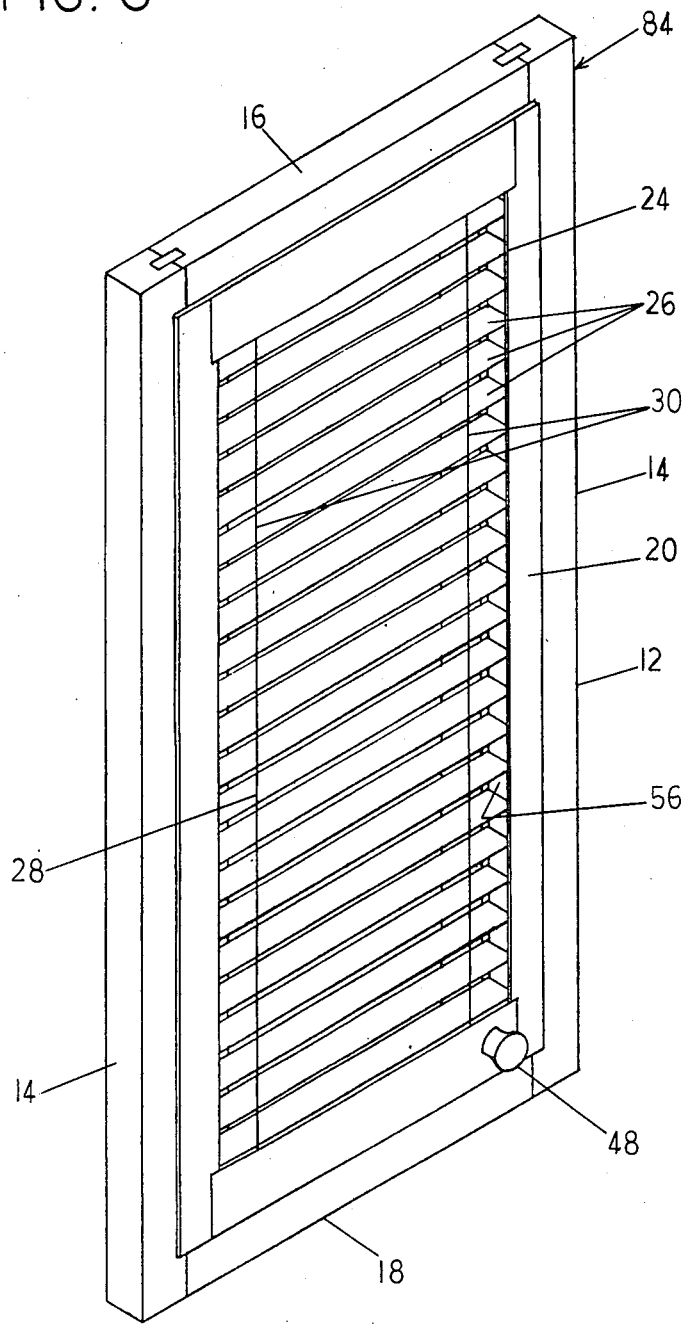
FIG. 6 is a second alternative embodiment of the shutter of the invention.

Shutters may be made in accord with the disclosure above that differ in appearance from the embodiment shown at 10. Alternative embodiments are shown generally at 82 in FIG. 5 and at 84 in FIG. 6. Certain parts and features of those embodiments directly corresponding to parts and features disclosed above with respect to the embodiment shown at 10 in FIG. 1 are given like numbers.

It is understood that the present invention is not limited to the particular construction and arrangement of parts illustrated and disclosed. Instead, it embraces all such modified forms thereof as come within the scope of the following claims.

What is claimed is:

1. A shutter adapted to be attached in hinged relation to a frame defining an opening, whereby at least part of the opening may be covered by the shutter, the shutter comprising:

(a) a shutter body having opposed top and bottom and opposed side body members, the body members defining a shutter opening;

(b) at least two flexible ladder suspension harnesses extending generally between the top and bottom body members and a plurality of movable slats extending horizontally across the shutter opening, individually suspended and vertically spaced from each other by the flexible ladder suspension harnesses, each harness having two, parallel vertical strands with each slat held in fixed relation to a selected location on each of the vertical strands, lateral movement of the slats being limited by the vertical strands and longitudinal movement of the slats being limited by the side body members;

(c) means to selectively lower and raise at least one of the vertical strands of each harness to rotate the slats about their longitudinal axis, said means including a control mechanism having (i) a tilt bar rotatable about an axis parallel to the longitudinal axis of the slats, on which tilt bar at least one of the vertical strands of each harness is wound, the tilt bar being adapted upon being rotated to raise and lower the vertical strands wound thereon relative to the other vertical strands of the harnesses associated therewith;

(ii) a manually actuable control knob adapted to be moved by a user of the shutter; and (iii) a mechanical linkage converting the motion of the control knob into rotation motion of the tilt bar; and (d) an anchor bar mounted on the body parallel to the slats and beyond the slat remote from the tilt bar, an elastic tension device attached to the body and to the anchor bar, the tension device being adapted to bias the anchor away from the tilt bar, the anchor bar being adapted to apply elastic force to the ends of the vertical strands remote from the tilt bar thereby holding the vertical strands taut.

2. The shutter specified in claim 1 wherein the control knob is adapted to be rotated and wherein the mechanical linkage converting the motion of the control knob into rotational motion of the tilt bar includes a first beveled gear system connected to a control rod that is connected to a second beveled gear system, the first beveled gear system being adapted to convert the rotational motion of the control knob into rotational motion of the control rod and the second beveled gear system being adapted to convert the rotational motion of the control rod into rotational motion of the tilt bar.

3. The shutter specified in claim 1 wherein each of the side, top, and bottom body members have front and rear sides and a recess extending the length of the body member, the recess being defined by a recess side generally parallel to the front and rear sides and a recess back extending between the recess side and the rear side, each body member further having a cover plate fastened to the rear side thereof and extending generally parallel to the recess side toward the shutter opening and a cover member extending between the recess side and the cover plate at a point intermediate the recess back and the shutter opening; and wherein the tilt bar and the mechanical linkage converting the motion of the control knob into rotational motion of the tilt bar all lie within the recesses of selected body members under the cover plates and between the recess backs and the cover members thereof so that substantially all of the moving parts of the means to selectively lower and raise the vertical strands are protected from any air and debris passing through the shutter when the slots are not closed, the cover member of the body member in which the tilt bar is located having access slots through which the vertical strands of the ladder suspension harnesses extend to be wound on the tilt bar.

4. The shutter specified in claim 3 including an anchor bar mounted on the body parallel to the slats and beyond the slat most remote from the tilt bar, the anchor bar being attached to at least one elastic tension device that in turn is attached to the body, the tension device being adapted to bias the anchor bar away from the tilt bar so as to apply elastic force to the vertical strands to hold the vertical strands taut, the anchor bar and the tension device being located in the recesses of body members underneath the cover plates and between the cover members and the recess backs thereof so that they are protected from any air and debris passing through the shutter when the slots are not closed, the cover member beind which the anchor bar is located having access slots through which the vertical strands of the ladder suspension harnesses extend to reach the anchor bar.

5. A shutter adapted to be attached in hinged relation to a frame defining an opening, whereby at least part of the opening may be covered by the shutter, the shutter comprising:

(a) a shutter body having opposed top and bottom and opposed side body members, the body members defining a shutter opening;

(b) at least two flexible ladder suspension harnesses extending generally between the top and bottom body members and a plurality of movable slats extending horizontally across the shutter opening, individually suspended and vertically spaced from each other by the flexible ladder suspension harnesses, each harness having two, parallel vertical strands with each slat held in fixed relation to a selected location on each of the vertical strands, lateral movement of the slats being limited by the vertical strands and longitudinal movement of the slats being limited by the side body members;

(c) means to selectively lower and raise at least one of the vertical strands of each harness to rotate the slats about their longitudinal axis, said means including a control mechanism having
(i) a tilt bar rotatable about an axis parallel to the longitudinal axis of the slats, on which tilt bar at least one of the vertical strands of each harness is wound, the tilt bar being adapted upon being rotated to raise and lower the vertical strands wound thereon relative to the other vertical strands of the harnesses associated therewith;
(ii) a manually actuable control knob adapted to be moved by a user of the shutter; and
(iii) a mechanical linkage converting the motion of the control knob into rotation motion of the tilt bar;
(d) an anchor bar mounted on the body parallel to the slats and beyond the slat most remote from the tilt bar; and
(e) a tension device attached to the body and to each end of the anchor bar such that the anchor bar is adapted to apply tension to the ends of the vertical strands remote from the tilt bar, the tension device being adapted to bias the anchor bar away from the tilt bar and including
(i) a cylinder rigidly attached to the body, opening away from the tilt bar and extending substantially parallel to the vertical strands;
(ii) a compression spring received in the cylinder; and
(iii) a piston received in the cylinder and biased by the compression spring away from the tilt bar, the piston further having a hole adapted to receive an end of the anchor bar to bias the anchor bar away from the tilt bar.

6. A shutter adapted to be attached in hinged relation to a frame defining an opening, whereby at least part of the opening may be covered by the shutter, the shutter comprising:
(a) a shutter body having opposed top and bottom and opposed side body members, the body members defining a shutter opening;
(b) at least two flexible ladder suspension harnesses extending generally between the top and bottom body members and a plurality of movable slats extending horizontally across the shutter opening, individually suspended and vertically spaced from each other by the flexible ladder suspension harnesses, each harness having two, parallel vertical strands with each slat held in fixed relation to a selected location on each of the vertical strands, lateral movement of the slats being limited by the vertical strands and longitudinal movement of the slats being limited by the side body members;
(c) means to selectively lower and raise at least one of the vertical strands of each harness to rotate the slats about their longitudinal axis, said means including a control mechanism having
(i) a tilt bar rotatable about an axis parallel to the longitudinal axis of the slats, on which tilt bar at least one of the vertical strands of each harness is wound, the tilt bar being adapted upon being rotated to raise and lower the vertical strands wound thereon relative to the other vertical strands of the harnesses associated therewith;
(ii) a manually actuable control knob adapted to be moved by a user of the shutter; and
(iii) a mechanical linkage converting the motion of the control knob into rotation motion of the tilt bar; and
(d) corner braces, each corner brace including a vertical member and a horizontal member joined at a substantially right angle, outwardly facing surfaces of the vertical member being adapted to be fastened to a selected surface of a side body member and outwardly facing surfaces of the horizontal member being adapted to be fastened to one of the top and bottom body members, a portion of the horizontal member including a bearing adapted to receive and hold in turning relation the tilt bar with the longitudinal axis thereof being substantially parallel to that of the horizontal member.

7. The shutter specified in claim 6 including an anchor bar mounted on the body parallel to the slats and beyond the slat most remote from the tilt bar, the anchor bar being adapted to apply tension to the ends of the vertical strands most remote from the tilt bar; and including a tension device having a cylinder opening away from the tilt bar, a compression spring received within the cylinder, and a piston received in the cylinder and biased by the compression spring away from the tilt bar, the piston having a hole adapted to receive an end of the anchor bar to bias the anchor bar away from the tilt bar.

8. The shutter specified in claim 7 wherein the vertical members of the corner braces each have a generally U-shaped cross section and include a floor at least partially closing the end of the vertical member remote from the horizontal member, the vertical member being adapted to receive and hold the cylinder and the floor serving to prevent movement of the cylinder toward the tilt bar.

9. A shutter adapted to be attached in hinged relation to a frame defining an opening, whereby at least part of the opening may be covered by the shutter, the shutter comprising:
(a) a shutter body having opposed top and bottom and opposed side body members, the body members defining a shutter opening, each of the side, top and bottom body members having front and rear sides and a recess extending the length of the body member, said recess being defined by a recess side generally parallel to the front and rear sides and a recess back extending between the recess side and the rear side, each body member further having a cover plate fastened to the rear side thereof and extending generally parallel to the recess side toward the shutter opening and a cover member extending between the recess side and the cover plate at a point intermediate the recess back and the shutter opening;
(b) at least two flexible ladder suspension harnesses extending generally between the top and bottom body members and a plurality of movable slats extending horizontally across the shutter opening, individually suspended and vertically spaced from each other by the flexible ladder suspension harnesses, each harness having two, parallel vertical strands with each slat held in fixed relation to a selected location on each of the vertical strands, lateral movement of the slats being limited by the vertical strands and longitudinal movement of the slats being limited by the side body members;
(c) means to selectively lower and raise at least one of the vertical strands of each harness to rotate the slats about their longitudinal axis, said means including a control mechanism having (i) a tilt bar rotatable about an axis parallel to the longitudinal axis of the slats, on which tilt bar at least one of the vertical strands of each harness is wound, the tilt bar being adapted upon being rotated to raise and lower the vertical strands wound thereon relative to the other vertical strands of the harnesses associated therewith;

(ii) a manually actuable control knob adapted to be moved by a user of the shutter; and (iii) a mechanical linkage converting the motion of the control knob into rotation motion of the tilt bar, said tilt bar and said mechanical linkage all lying within the recesses of selected body members under the cover plates and between the recess backs and the cover members thereof, the cover member of the body member in which the tilt bar is located having access slots through which the vertical strands of the ladder suspension harnesses extend to be wound on the tilt bar;

(d) an anchor bar mounted on the body parallel to the slats and beyond the slat most remote from the tilt bar and located in the recesses of body members underneath the cover plates and between the cover members and the recess backs thereof, the cover member behind which the anchor bar is located having access slots through which the vertical strands of the ladder suspension harnesses extend to reach the anchor bar;

(e) at least one tension device that is attached to the body and is located in the recesses of body members underneath the cover plates and between the cover members and the recess backs thereof, said tension device being attached to the anchor bar; and (f) corner braces, each corner brace including a vertical member and a horizontal member joined at a substantially right angle, each corner brace being adapted to be contained within the recesses of selected body members under the cover plates and between the recess backs and cover members thereof with the horizontal members being adapted to be contained within one of the top and the bottom body members and the vertical members being adapted to be contained within a side body member, a portion of each horizontal member including a bearing adapted to receive and hold in turning relation the tilt bar with the longitudinal axis thereof held substantially parallel to that of the horizontal member, the vertical members of the corner braces each having a generally U-shaped cross section and including a floor at least partially closing the end of the vertical member remote from the horizontal member, the vertical member being adapted to receive and hold the tension device with the floor thereof serving to prevent movement of the tension device toward the tilt bar.

* * * * *